US005706015A

United States Patent [19]

Chen et al.

[11] Patent Number: 5,706,015

[45] Date of Patent: Jan. 6, 1998

[54] FLAT-TOP ANTENNA APPARATUS INCLUDING AT LEAST ONE MOBILE RADIO ANTENNA AND A GPS ANTENNA

[75] Inventors: Shun-Ping Chen, Düsseldorf; Manfred Burkert, Bockenem; Reinhard Berfelde, Diekholzen; Christian Heuer, Hildesheim, all of Germany

[73] Assignee: Fuba Automotive GmbH, Bad Salzdetfurth, Germany

[21] Appl. No.: 607,996

[22] Filed: Mar. 4, 1996

[30] Foreign Application Priority Data

Mar. 20, 1995 [DE] Germany ..... 195 14 556
Dec. 9, 1995 [DE] Germany ..... 195 46 010

[51] Int. Cl.[6] ..... H01Q 1/32; H01Q 1/38

[52] U.S. Cl. ..... 343/700 MS; 343/713; 343/725

[58] Field of Search ..... 343/700 MS, 711, 343/712, 713, 725, 729; H01Q 1/32, 1/38

[56] References Cited

U.S. PATENT DOCUMENTS

| | | | |
|---|---|---|---|
| 4,907,006 | 3/1990 | Nishikawa et al. | 343/700 MS |
| 5,099,249 | 3/1992 | Seavey | 343/700 MS |
| 5,121,127 | 6/1992 | Toriyama | 343/700 MS |
| 5,153,600 | 10/1992 | Metzler et al. | 343/700 MS |
| 5,420,136 | 5/1995 | Goto et al. | 343/700 MS |
| 5,444,522 | 8/1995 | Itoh et al. | 343/700 MS |

FOREIGN PATENT DOCUMENTS

| | | |
|---|---|---|
| 9414817 U | 12/1994 | Germany . |
| 4135828 | 8/1995 | Germany . |
| 29506693 | 8/1995 | Germany . |

OTHER PUBLICATIONS

Original Multilayer Microstrip Disk Antenna for Dual–Frequency Band Operation, Theory and Experiment, IEEE Proceedings–H, vol. 140, No. 6, Dec. 1993, pp. 441–446.

*Primary Examiner*—Hoanganh T. Le
*Attorney, Agent, or Firm*—Michael J. Striker

[57] ABSTRACT

The flat-topped antenna apparatus includes a GPS antenna, a mobile radio antenna, a common housing for the antennas mounted over a ground plane and coaxial cables (12,13,13*a*) acting as electrical supply lines for the antennas. The mobile radio antenna includes a metal sheet (6,6',6*a*) plane parallel to the ground plane and spaced at a distance (A,A') of 0.04 of an average operating wavelength of a mobile radio frequency band from the ground plane. The metal sheet is electrically connected at an input terminal (11) with an inner conductor (10) of one coaxial cable (13,13*a*) and also with the ground plane via a short circuit element (7,7*a*). The GPS antenna is above and rests on the mobile radio antenna and includes a dielectric plate (1,1*a*) provided with a metal layer (3) connected at an input terminal (4) with an inner conductor (10) of another (12) of the coaxial cables. The end points (14,15) of the outer conductors of the coaxial cables located near the respective input terminals (4,11) of both antennas are electrically connected to ground. At least one outer conductor is electrically connected to ground again at a connection point (16) which is located at a distance ($d_{1/4}$) of one quarter of the average operating wavelength from the grounded end point of the at least one outer conductor.

16 Claims, 6 Drawing Sheets

FLAT-TOP ANTENNA APPARATUS INCLUDING AT LEAST ONE MOBILE RADIO ANTENNA AND A GPS ANTENNA

BACKGROUND OF THE INVENTION

The present invention relates to a combined flat-topped antenna apparatus including an antenna for satellite vehicle navigation (GPS) and at least one other antenna for mobile radio communication.

This type of plane antenna arrangement is known and comprises an antenna for satellite vehicle navigation and at least one antenna for mobile radio communication. These antennas can be arranged in a common housing on a plane conductive body of comparatively large extension, particularly on a motor vehicle chassis. The GPS antenna advantageously is a strip antenna with transverse radiation which comprises a plate made from a partially metallized dielectric material. The mobile radio communication antenna advantageously has a circular characteristic in a horizontal radiation pattern diagram and the body reference plane can provide the conductive surface of comparatively large extension.

Antenna combinations, which comprise plane antenna arrangements for different frequency bands, are known. U.S. Pat. No. 5,124,714 and German Utility Model Patent G 94 14 817 describe twin antennas for motor vehicles which are representative of the prior art. To obtain a plane combination of two antennas which do not or do not substantially protrude from the motor vehicle body contour, in both cases a slot antenna was selected for the low frequency band with a closed circumferential slot, which is integrated in the metal panel of the motor vehicle body(roof or, e.g., the trunk hood). An additional slot structure—a circular slot for a higher frequency band—is provided on the inner surface of the slot arrangement in one embodiment of the antenna arrangement described in U.S. Pat. No. 5,124,714. A patch antenna is also erected in the center in one embodiment according to German Utility Model Patent 94 14 817. The outer slot arrangement is used for mobile radio communication in the 900 MHz band and the inner arrangement is used for GPS.

There is no doubt that the above-described combination antenna arrangements for both systems have satisfactory reception and transmission properties as well as good impedance matching. At least in the case of the twin antenna arrangement it seems to be possible to integrate them into the motor vehicle body so that the final result cannot be detected by an observer.

One disadvantage of these systems is that the compact arrangement of both antennas—one nearly in the other—may be accomplished in a space saving way only by combination of the 900 MHz band with the 1.575 GHz band or with the 1.8 GHz band.

An antenna for mobile radio communication in the 1.8 GHz band and the GPS antenna could not be combined with these structural principles because of the almost equal dimensions of both antennas. That is also true for the arrangements with two slot antennas, such as a patch antenna for a GPS closely mounted over a small circular slot antenna for 1.8 GHz. The patch antenna covers the circular slot antenna and prevents its field from forming.

An additional problem occurs, among others, when the slot in the motor vehicle body is not available in every situation and when the space available for the supporting structure is also not available, e.g. when it is available only under the auto roof. Also engineering stability and sealing problems, which impair the installation of the antenna arrangement, can also occur with this type of antenna arrangement.

SUMMARY OF THE INVENTION

It is an object of the present invention to provide an antenna module apparatus for satellite-supported vehicle navigation (GPS) and for mobile radio communication, in which a strip antenna for the GPS band can be combined with a plane antenna for radio communication in the 900 MHz band and/or with an antenna for 1.8 GHz.

According to the invention the flat-topped antenna apparatus comprises an antenna for satellite vehicle navigation (GPS), at least one antenna for mobile radio communication, a common housing accommodating the antennas and arranged on a conducting surface acting as a ground plane for the antennas, and coaxial cables acting as electrical supply lines for the antennas and each comprising an inner conductor and an outer conductor. The at least one antenna for mobile radio communication has a substantially circular horizontal radiation diagram and comprises a metal sheet plane parallel to the ground plane, spaced from the ground plane at a distance of 0.04 of an average operating wavelength of a mobile radio frequency band used for mobile radio communication and is electrically connected with the ground plane by means of at least one short circuit element and an intervening member. The antenna for satellite vehicle navigation rests over the at least one antenna for mobile radio communication and comprises a dielectric plate provided with a metal layer. A portion of the inner conductor of the coaxial cable supplying the at least one antenna for mobile radio communication is exposed and passes through a space under the metal sheet of the antenna for the satellite vehicle navigation. End points of the outer conductors of the coaxial cables located in the vicinity of respective input terminals of the antenna for satellite vehicle navigation and the at least one antenna for mobile radio communication are electrically connected to ground. At least one outer conductor is grounded again at at least one connection point (16). The at least one connection point of the outer conductors is at a distance of one quarter of the average operating wavelength of the at least one antenna for mobile radio communication from the at least one grounded end point.

The antenna apparatus according to the invention provides the following advantages:

- the GPS-antenna can also be combined with a radio antenna for the 1.8-GHz band and good radiation performance is guaranteed for each antenna;
- the combination of the GPS-antenna is possible with one or more mobile radio communication antennas according to choice; and
- the flat-topped antenna principle and a compact, flat structure are retained for the entire antenna apparatus.

Thus the structure of the entire antenna apparatus and the individual components is considerably simplified and it provides many starting points for economical detailed solutions of engineering and technical problems.

In a preferred embodiment of the invention the metal layer of the dielectric plate is a metal patch acting as a radiating surface and extending over only a portion of the dielectric plate surface. The dielectric plate has another metal layer provided on a side opposite from the metal patch acting as a ground layer of the GPS antenna. The metal patch advantageously has a high frequency effective edge length of about ½ of an average operating wavelength of the GPS frequency band of the GPS antenna for satellite vehicle navigation. The dielectric plate in this embodiment is positioned so that the ground layer of the GPS antenna is at least partially covering the antenna or antennas for mobile radio communication. The dielectric plate is advantageously spaced from the metal sheet of the antenna or antennas for mobile radio communication at least 2 mm or by a dielectric layer. The metal sheet is in the form of a circular sector having radial edges, which are approximately 90° to each other and which have a length equal to ¼ of the average operating wavelength of the radio frequency band for mobile radio communication. Furthermore in this embodiment the at least one short circuit element is located at a side edge of the metal sheet to provide a galvanic connection and/or a capacitive high frequency coupling between the metal sheet and the conducting surface acting as the ground plane.

In another preferred embodiment the metal layer of the dielectric plate acts as a radiating surface and has a lateral shape and dimensions equal to those of the dielectric plate, the dielectric plate is centrally mounted without a gap on the metal sheet of the at least one radio antenna for mobile radio communication and the metal sheet simultaneously acts as ground layer of the GPS antenna and extends over only a portion of a surface of the dielectric plate, the metal sheet is circular and has a diameter of about the average operating wavelength of a mobile radio frequency band used for mobile radio communication. The relative dielectric constant $\epsilon_r$ of the dielectric plate is selected so that a diagonal of the dielectric plate can be smaller than the diameter of the metal sheet. Also in this embodiment the at least one short circuit element is spaced laterally from a side edge of the metal sheet to provide a galvanic connection and/or a capacitive high frequency coupling between the metal sheet and the conducting surface acting as the ground plane.

In other advantageous embodiments the at least one antenna for mobile radio communication consists of two mobile radio communication antennas, each comprising one of the metal sheet connected with the conducting surface acting as the ground plane by one of the short circuit elements and the two mobile radio communication antennas are positioned so that lateral edges of the metal sheet with the short circuit elements are positioned over each other.

The antennas can be connected mechanically and electrically with socket connections and the antenna apparatus according to the invention can include a universal base plate on which the conducting surface acting as the ground plane is provided. The universal base plate can be a complex injection molded part, can have a gently curved concave surface on a side opposite the antennas for attachment to a motor vehicle chassis, and can include holding means for releasable attachment of the universal base plate with a motor vehicle chassis so that a spacing between the universal base plate and a curved panel of the motor vehicle chassis is as small as possible.

The at least one short circuit element can consists of an electrically conductive body such as a metal pin or conductive crosspiece.

The GPS antenna is advantageously a strip antenna with transverse radiation.

BRIEF DESCRIPTION OF THE DRAWING

The objects, features and advantages of the present invention will now be illustrated in more detail by the following description, reference being made to the accompanying drawing in which:

FIG. 1 *b*) is a top view of the antenna apparatus shown in FIG. 1 *a*) without the housing cover;

FIG. 2 *b*) is a top view of the antenna apparatus shown in FIG. 2 *a*);

DESCRIPTION OF THE PREFERRED EMBODIMENTS

Figure 1A:
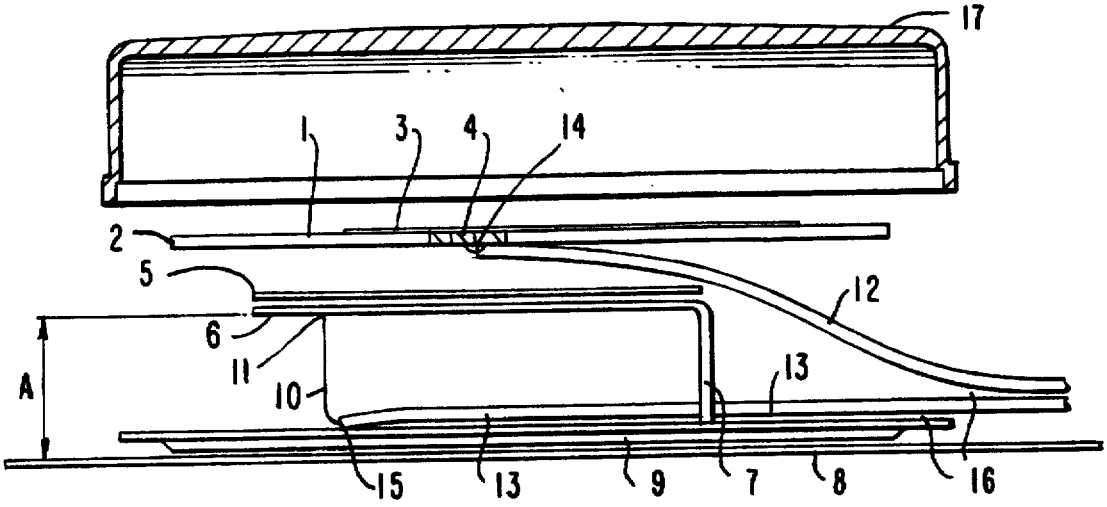
FIG. 1 *a*) is an exploded partially side, partially cross-sectional view of an antenna apparatus according to the invention including a GPS antenna and an antenna for mobile radio communication.
Figure 1B:
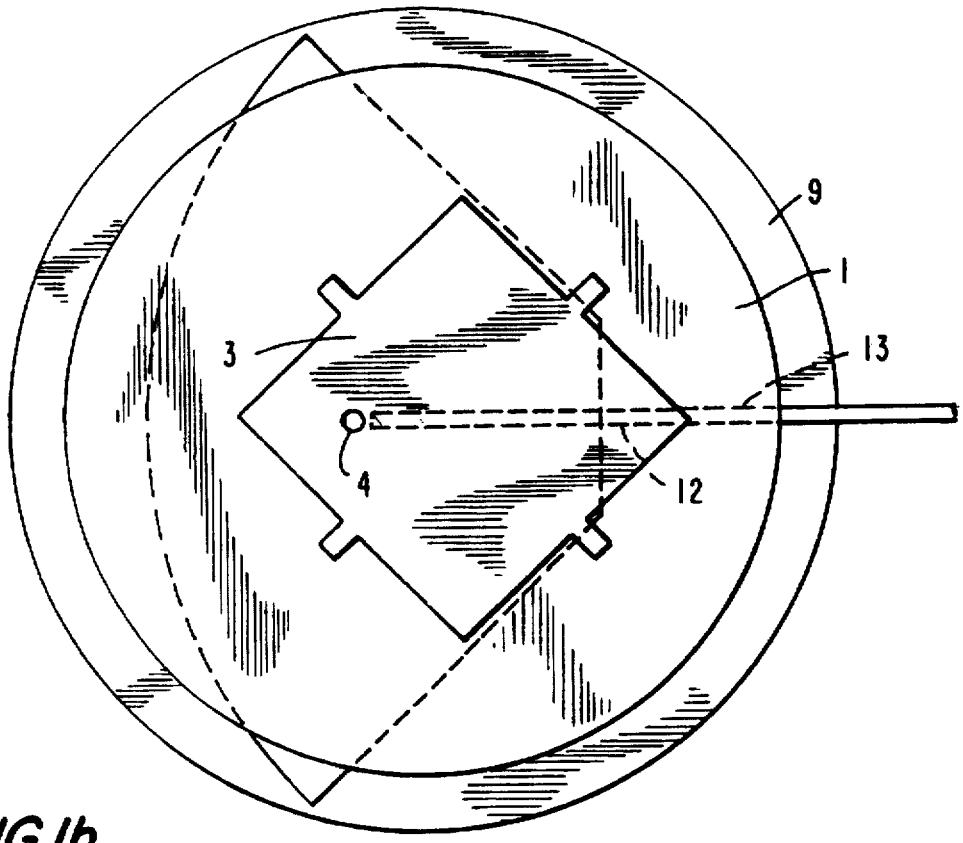

FIG. 1*a* and 1*b* are different two views of an antenna apparatus according to the invention which comprises a GPS antenna and an antenna for mobile radio communication radiating in the 900 MHz band.

The GPS antenna comprises a dielectric plate 1, like those used for printed circuits, a rectangular metal patch 3 on the dielectric plate 1 providing a radiating surface and a planar metal layer 2 on the other side of the dielectric plate 1 acting as a ground layer. The input terminal 4 for the metal patch 3 is arranged beyond the surface center point because the GPS antenna operates with circular polarization.

The dielectric plate 1 has a diameter of 85 mm and the radiating surface an edge length of 50 mm. The effective edge length corresponds to ½ of the average operating wavelength of the GPS band, and the geometric extent depends in practice on the shortening factor associated with the relative dielectric constant of the plate material. The edge length of 50 mm implies an $\epsilon_r$=4.

The ground layer 2 of the GPS antenna must be galvanically separated from the underlying antenna in this embodiment, e.g. by an air gap of at least 2 mm width or by an intermediate foil made from a dielectric material.

The metal sheet 6 and the short-circuiting element 7 in the present embodiment together with the ground panel 8, e.g. the roof of a metal motor vehicle chassis, form a hollow resonator for predetermined operating frequencies, at whose open end an exterior field pattern is formed with nondirectional radiation in the remote radiation field. The metal sheet 6 in this embodiment is formed in the shape of a circular sector with an angle of 90° between its lateral radial edges and a radius of 90 mm. The radial edge dimensions are derived from ¼ of the average operating wavelength of the radio frequency band used for mobile radio communication. The dimension A between the metal sheet 6 and the ground panel 8 should amount to at least 0.04 times the wavelength to guarantee sufficient values of the bandwidth and output.

In practice the short circuit element 7 is not directly connected with the metal ground panel 8 of the chassis or an appropriate ground plane. The thin metallic base plate 9 of the antenna housing, on which the means for mechanical support of the housing on the understructure or chassis of the motor vehicle are provided, acts as intermediate and connecting members. In the embodiment according to FIG. 1 these intermediate and connecting members could be, for example, adherent magnets, which project from the underside of the base plate 9 and are supported movably. Because of that, it is essential that the spacing between the base plate 9 and the metal ground panel 8 be as small as possible (i.e. smaller than 1 mm), so that a good capacitive coupling between both ground elements is guaranteed. This effect can be promoted in the antenna apparatus according to the invention, which is based on the concept of releasable attachment to the motor vehicle roof if the underside of the base plate 9 is formed so that it is gently concave and fits approximately to the arc of the chassis ground panel surface.

A galvanic ground connection is made in the usual way in the antenna apparatus according to the invention, which, like the common roof antenna,—e.g. short rod antenna—are attached by screwing above a hole in the roof panel or sheet. The high frequency conductors are also guided through the opening in the roof panel from the antennas into the vehicle interior.

The interior conductor 10 of connecting cable 13 is exposed for a portion of its length inside the space under the metal sheet 6 up to the connection point with the input terminal 11. This interior conductor 10 is part of the mobile radio antenna device according to the invention.

The end points 14 and 15 of the outer conductors of both coaxial cables 12 and 13 at or near the respective input terminals 4 and 11 are connected with the ground plane 8/9 and the ground layer 2 respectively. These end points 14 and 15 are electrically connected to ground by the outer conductors at connection points 16 which are a distance $d_{1/4}$ of ¼ of the average operating wavelength of the mobile radio antenna from the contact points 14 and 15. Because of this arrangement, the influence of the comparatively large ground layer 2 of the GPS antenna on the field strength of the mobile radio antenna is certainly neutralized: The plate 1 with the conducting surface of ground layer 2 and the metal sheet 6—above all because of spatial considerations—are one above the other but close to each other, advantageously separated by an additional dielectric layer 5, so that normally an exchange and thus an outflow of signal energy by capacitive coupling cannot be avoided between the ground plane 2 and the metal sheet 6. In the quarter wavelength portion of the outer conductor of the coaxial cable between the connection points 4 and 16 and 11 and 15 respectively a standing wave is provided with formation of a voltage maximum and with a current flow equal to zero at end points 14 and/or 15 according to the standard conduction theory for conductors with short circuits, since the nodes of current and voltage are displace from each other by a quarter wavelength. Thus the HF-power, which is excited in the ground layer 2 from metal sheet 6 during mobile radio operation, cannot be dissipated over the outer conductor of cable 12 of the GPS antenna.

Figure 2A:
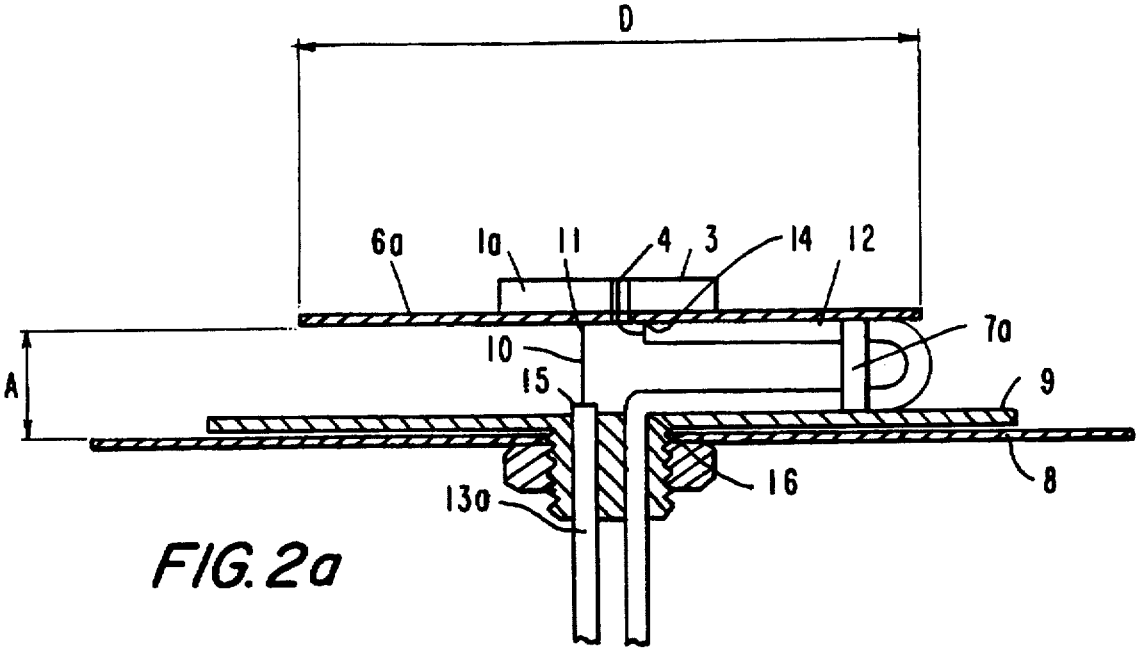
FIG. 2 *a*) is a side cross-sectional view of another embodiment of an antenna apparatus according to the invention having a simplified structure.
Figure 2B:
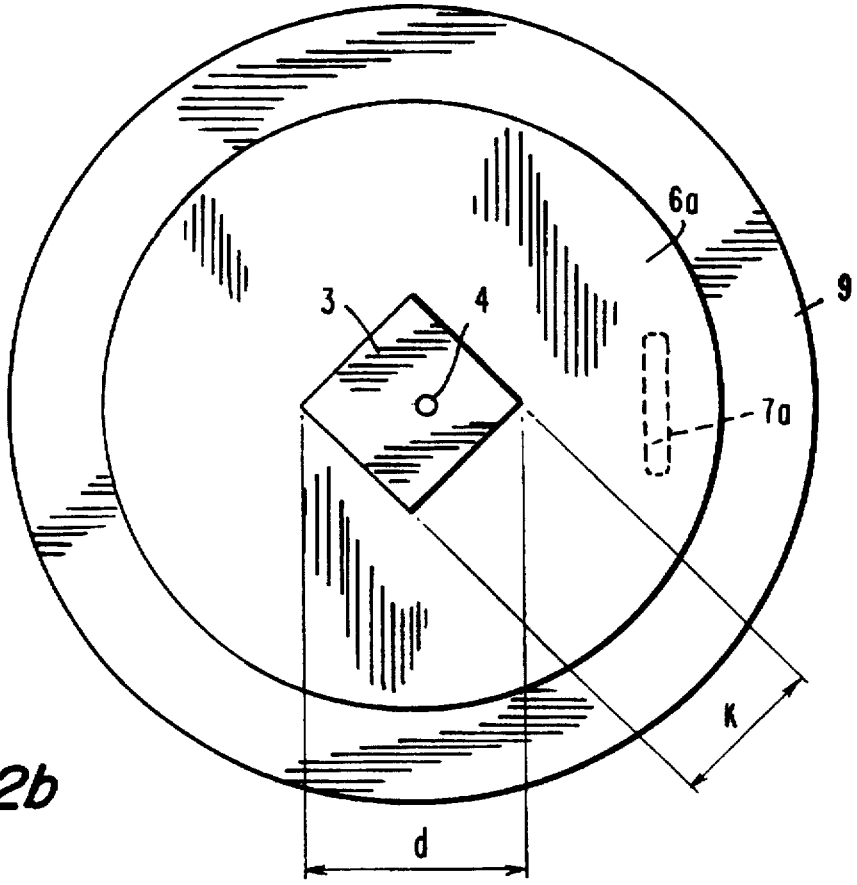

FIG. 2 shows an antenna apparatus, which is a surprisingly and advantageously improved embodiment of the invention. This embodiment is above all a simpler structure for the GPS strip antenna. Because the comparatively large sized plate 1 which is metallized on both sides is replaced in this embodiment with the comparatively smaller dielectric plate 1*a* in the form of a disk, which has only one planar metal layer 3 which acts as a radiating surface. The additional dielectric 5 or the spacing between the dielectric plate 1 and the metal sheet 6 present in the embodiment of FIG. 1 can be entirely eliminated. In this embodiment the metal sheet 6*a* of the radio antenna is simultaneously the ground layer for the GPS strip antenna and thus fulfills an additional purpose. The metal sheet 6*a* is circular and the plate 1*a* is centered with the radiating surface of the GPS-antenna. The short circuit element 7*a* is arranged inside the circumferential edge of the metal sheet 6 in a laterally displaced position.

The short circuit element 7*a* can—like the element 7 in the embodiment of FIG. 1—also be formed from one or more metal pins, electrically conductive crosspieces or the like electrically conductive bodies.

In the structure shown in FIG. 2 only one connection point 16 for the outer conductors of the cables of the GPS antenna is required and is located at a distance $d_{1/4}$ of one quarter of the average mobile radio band operating wavelength from input terminal 4.

The dimensions of the individual components of the arrangements in accordance with the characteristic measured properties of both antenna types are adjusted to the average operating wavelength of the associated frequency band. Thus the diameter D=¼ of the average operating wavelength and the spacing A=0.04 times the average operating wavelength of the mobile radio band. The effective edge length of the planar metal layer 3 amounts to one half of the average operating wavelength for the GPS frequency. For the geometric dimensions of the planar metal layer 3 and thus the dielectric plate 1*a* the plate material is selected so that the dimension d of the diagonal is less than the diameter D of the metal sheet 6*a*.

In the embodiment of FIG. 2 D=80 mm, A=15 mm and K=25 mm with a 900 MHz radio antenna and with a dielectric plate 1*a* with $\epsilon_r$=15.

Additional material, construction and assembly costs are saved in this second embodiment by reducing the plate size to the dimensions of the radiating surface of metal layer 3, by only metallizing on one side of the dielectric plate and by eliminating the dielectric layer 5. The height of the antenna arrangement is reduced in this second embodiment.

Figure 3A:
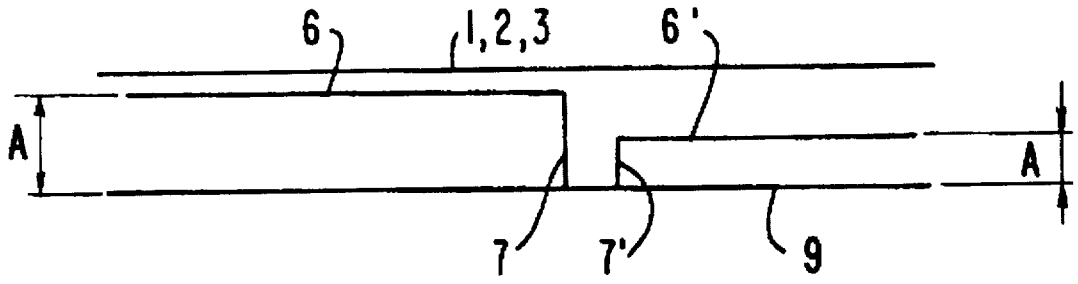
FIGS. 3 *a*) and *b*) are diagrammatic views of two different embodiments of an antenna apparatus according to the invention each having a GPS antenna and two antennas for mobile radio communication.
Figure 3B:
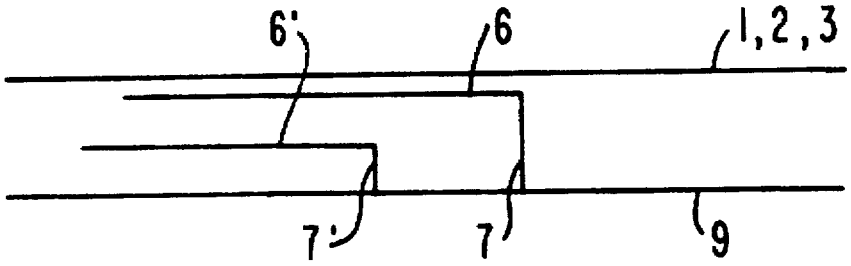

In addition to the embodiment shown in FIG. 1—embodiments of an antenna apparatus including two mobile radio antennas together with the GPS-antenna are shown diagrammatically. The metal sheets 6 and 6*a* are beside or next to each other in the embodiment of FIG. 3*a* and are almost over each other in the embodiment shown in FIG. 3*b*. In both cases the GPS antenna can be set up on the metal sheet 6 of the antenna of the lower radio frequencies—with an intervening dielectric layer.

The structural components on the base plate 9 are covered with the housing cover 17 (FIG. 1) made of a dielectric material and sealed in the housing 9, 17 from moisture. An advantageous embodiment would also correspond to one in which the entire antenna apparatus comprises molded parts made from plastic foam whose outer surface corresponds to that of the cover 17 (FIG. 1). The plastic foam housing would permanently hold the antenna parts simultaneously in position.

Figure 4:
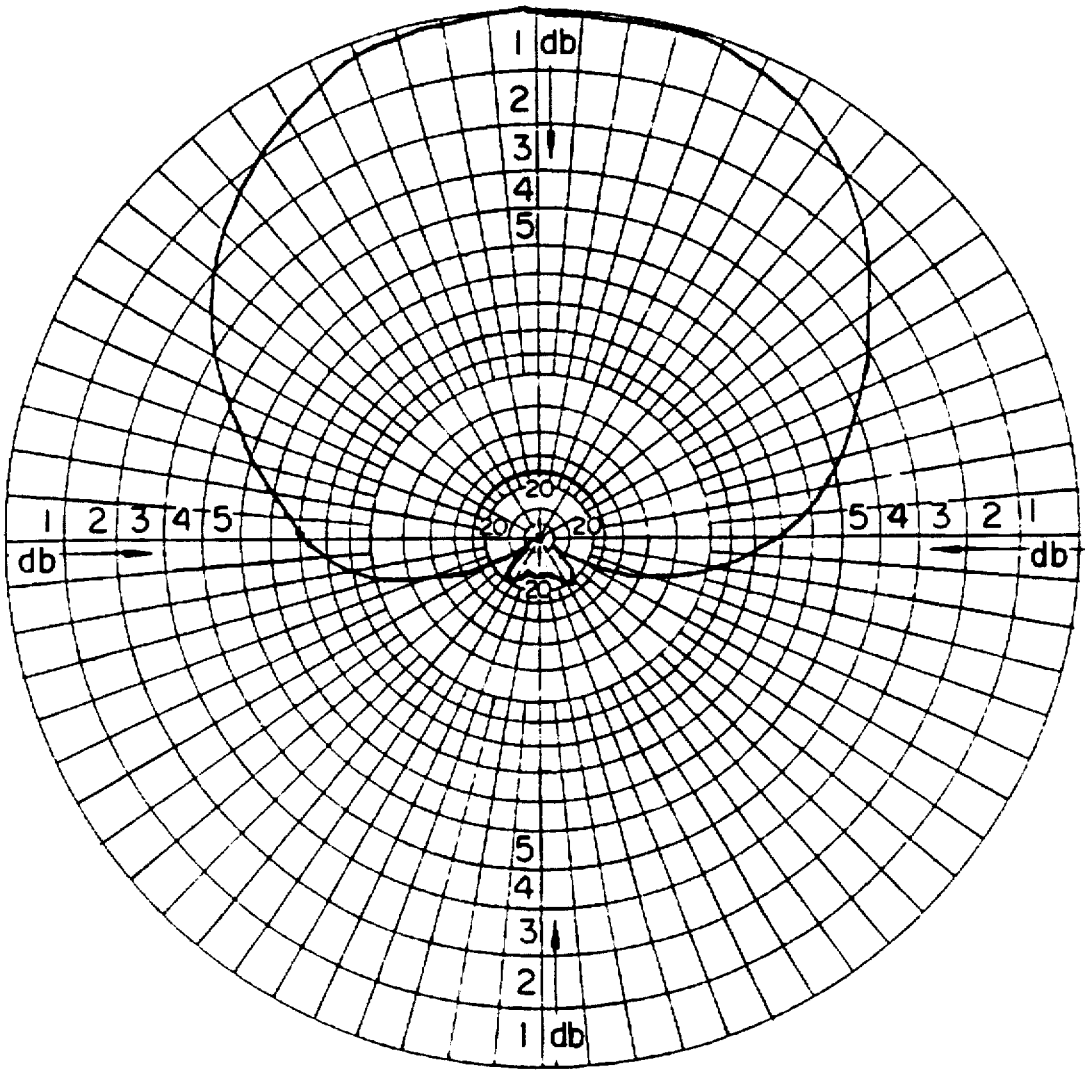
FIG. 4 is a vertical radiation pattern diagram for a GPS antenna radiating at 1.570 GHz.
Figure 5:
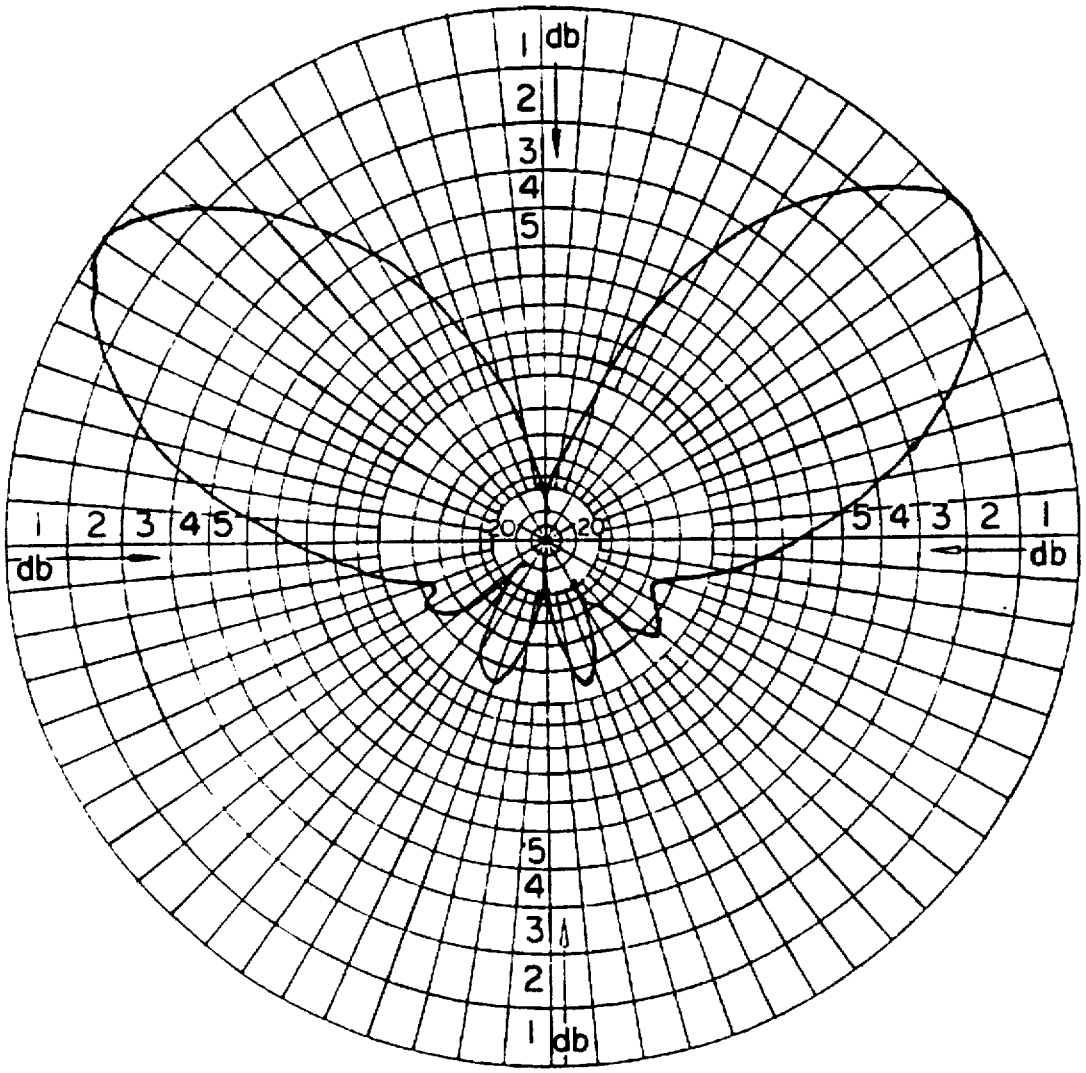
FIG. 5 is a vertical radiation pattern diagram for a mobile radio communication antenna radiating at 925 MHz.
Figure 6:
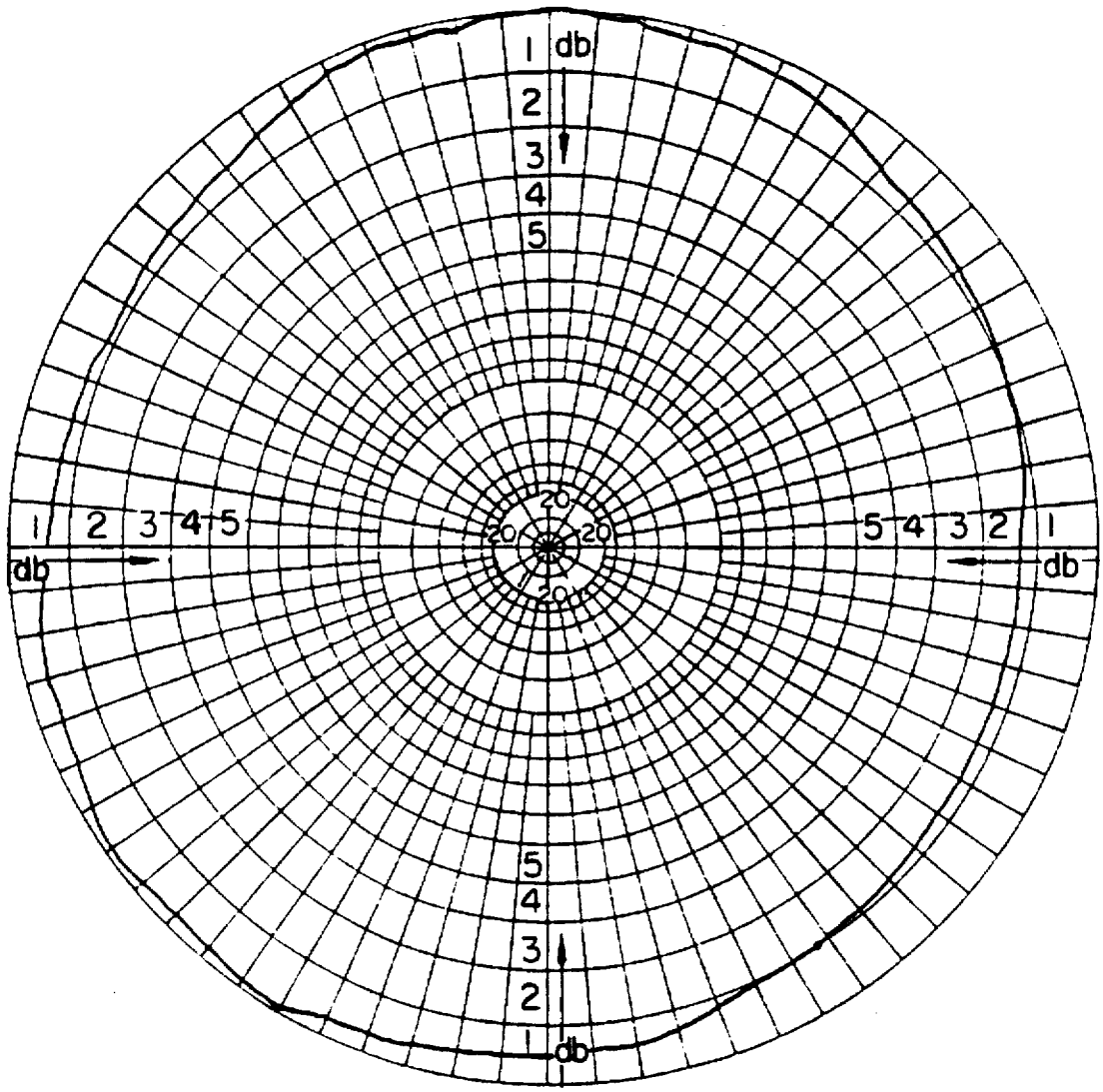
FIG. 6 is a horizontal radiation pattern diagram for a mobile radio communication at 925 MHz.

In FIGS. 4 to 6 characteristic radiation diagrams are illustrated which were obtained with the antenna apparatus according to the invention with a GPS antenna and a mobile radio antenna for the 900-MHz frequency band. The shape of each diagram speaks for itself. These measurements have shown that the characteristic radiation diagrams obtained with the antenna apparatus according to the invention are identical with those obtained when each antenna is separately tested. Above all, no level differences are established.

The performance of the antenna arrangement according to the invention in the mobile radio range is completely identical with the conventional, quarter wavelength rod antenna. For the GPS band 3 dB-ish performance results which is conventional with strip antennas of this type and is completely satisfactory.

While the invention has been illustrated and described as embodied in a combined flat-topped antenna apparatus including an antenna for satellite vehicle navigation (GPS) and at least one other antenna for mobile radio communication, it is not intended to be limited to the details shown, since various modifications and structural changes may be made without departing from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A flat-topped antenna apparatus comprising an antenna for satellite vehicle navigation (GPS), at least one antenna for mobile radio communication, a housing arranged on a conducting surface, said housing being positioned over said antenna for satellite vehicle navigation and said at least one antenna for mobile radio communication and said conducting surface acting as a ground plane for said antennas, and coaxial cables (12,13,13*a*) acting as electrical supply lines for said antennas and each comprising an inner conductor (10) and an outer conductor;

wherein said at least one antenna for mobile radio communication has a substantially circular horizontal radiation diagram and comprises a metal sheet (6,6', 6*a*) plane parallel to said ground plane, said metal sheet (6,6',6*a*) is spaced from said ground plane at a distance (A,A') of 0.04 of an average operating wavelength of a mobile radio frequency band used for said mobile radio communication, is electrically connected with the inner conductor (10) of one (13,13*a*) of said coaxial cables at an input terminal (11) of the metal sheet and is electrically connected with said ground plane by means of at least one short circuit element (7,7*a*) and an intervening member;

wherein said antenna for satellite vehicle navigation is above and rests on said at least one antenna for mobile radio communication and comprises a dielectric plate (1,1*a*) provided with a metal layer (3) and said metal layer (3) is electrically connected with the inner conductor (10) of another (12) of the coaxial cables at an input terminal (4) of the metal layer (3);

wherein a portion of said inner conductor (10) of said coaxial cable (13,13*a*) electrically connected to said at least one antenna for mobile radio communication is exposed and passes through a space under said metal sheet (6,6',6*a*); end points (14,15) of the outer conductors of said coaxial cables (12,13,13*a*) are located in the vicinity of respective ones of said input terminals (4,11) of said antenna for satellite vehicle navigation and said at least one antenna for mobile radio communication; said end points (14,15) of the outer conductors are electrically connected to ground; and at least one of said outer conductors is electrically connected to ground again at a connection point (16), and said connection point (16) is located at a distance ($d_{1/4}$) of one quarter of said average operating wavelength of said at least one antenna for mobile radio communication from said end point (14,15) of said at least one outer conductor.

2. The flat-topped antenna apparatus as defined in claim 1, wherein said metal layer (3) of said dielectric plate (1) is a metal patch acting as a radiating surface and extending over only a portion of a surface of said dielectric plate (1) and said dielectric plate has another metal layer (2) provided on a side opposite from said metal patch (3) acting as a ground layer of said antenna for satellite vehicle navigation, said metal patch (3) having a high frequency effective edge length of about ½ of an average operating wavelength of a GPS frequency band of said antenna for satellite vehicle navigation; said dielectric plate (1) is positioned so that said ground layer (2) of said antenna for satellite vehicle navigation is at least partially covering said at least one antenna for mobile radio communication; said dielectric plate (1) is spaced from said metal sheet (6) of said at least one antenna for mobile radio communication; said metal sheet (6) is in the form of a circular sector having radial edges, said radial edges are approximately 90° to each other and said radial edges have a length equal to ¼ of said average operating wavelength of said mobile radio frequency band for mobile radio communication; and said at least one short circuit element (7) is located at a side edge of said metal sheet (6) to provide at least one of a galvanic connection and a capacitive high frequency coupling with said metal sheet (6,6') and said conducting surface acting as said ground plane.

3. The flat-topped antenna apparatus as defined in claim 2, wherein said dielectric plate (1) is spaced a distance of at least 2 mm from said metal sheet (6).

4. The flat-topped antenna apparatus as defined in claim 2, further comprising a dielectric layer (5) provided between said dielectric plate (1) and said metal sheet (6) to space said metal sheet (6) from said dielectric layer (5).

5. The flat-topped antenna apparatus as defined in claim 2, wherein one (14) of said end points of one of said outer conductors of said coaxial cables is connected to said ground layer (2) on said dielectric plate, said connection point (16) is spaced said distance ($d_{1/4}$) from said one (14) of said end points and said connection point (16) connects said one of said outer conductors with said ground plane of said at least one antenna for mobile radio communication.

6. The flat-topped antenna apparatus as defined in claim 1, wherein said metal layer (3) of said dielectric plate (1*a*) acts as a radiating surface and has a lateral shape and dimensions equal to those of said dielectric plate (1*a*), said dielectric plate (1*a*) is centrally mounted on said metal sheet (6*a*) of said at least one antenna for mobile radio communication without gap between the dielectric plate (1*a*) and the metal sheet (6*a*) and said metal sheet (6*a*) simultaneously acts as a ground layer of said antenna for satellite radio communication and extends over only a portion of a surface of said dielectric plate (1*a*), said metal sheet (6*a*) is circular, has a diameter (D) of about said average operating wavelength of a mobile radio frequency band used for mobile radio communication and said relative dielectric constant 531 $_r$ of said dielectric plate (1*a*) is selected so that a diagonal (d) of said dielectric plate can be smaller than said diameter (D) of said metal sheet (6*a*) and said at least one short circuit element (7*a*) is spaced laterally from a side edge of said metal sheet (6*a*) to provide at least one of a galvanic connection and a capacitive high frequency coupling with said metal sheet (6*a*) and said conducting surface acting as said ground plane.

7. The flat-topped antenna apparatus as defined in claim 6, wherein one (14) of said end points of one of said outer conductors of said coaxial cables is connected to said metal sheet (6*a*) acting as said ground layer (2) of said antenna for satellite radio communication, said connection point (16) is spaced said distance ($d_{1/4}$) from said one (14) of said end points and said connection point (16) connects said one of said outer conductors with said ground plane of said at least one antenna for mobile radio communication.

8. The flat-topped antenna apparatus as defined in claim 1, wherein said at least one antenna for mobile radio communication consists of two mobile radio communication antennas, each of said two mobile radio communication antennas comprising said metal sheet (6,6') and said at least one short circuit elements (7,7') and said two mobile radio communication antennas are positioned so that lateral edges of said metal sheets (6,6') are positioned over each other.

9. The flat-topped antenna apparatus as defined in claim 8, wherein a higher one of said metal sheets (6,6') is part of a lower frequency one of said mobile radio communication antennas and said higher metal sheet is connected with said dielectric plate (1).

10. The flat-topped antenna apparatus as defined in claim 1, wherein said antennas are provided with socket connections for mechanical and electrical connection, and further comprising a universal base plate (9) to provide said conducting surface acting as said ground plane.

11. The flat-topped antenna apparatus as defined in claim 10, wherein said universal base plate (9) is an injection molded part.

12. The flat-topped antenna apparatus as defined in claim 10, wherein said universal base plate (9) has a concave surface on a side opposite said antennas for attachment to a curved panel (8) of a motor vehicle chassis, and further comprising holding means for releasable attachment of the universal base plate (9) with said motor vehicle chassis so that a spacing between said universal base plate (9) and said curved panel (8) of said motor vehicle chassis is as small as possible.

13. The flat-topped antenna apparatus as defined in claim 1, wherein said at least one short circuit element (7,7*a*) consists of an electrically conductive body.

14. The flat-topped antenna apparatus as defined in claim 13, wherein said electrically conductive body is an electrically conductive crosspiece.

15. The flat-topped antenna apparatus as defined in claim 13, wherein said electrically conductive body is a metal pin.

16. The flat-topped antenna apparatus as defined in claim 1, wherein said antenna for satellite vehicle navigation is a strip antenna with transverse radiation.

* * * * *